US007260893B2

(12) United States Patent
Calhoun et al.

(10) Patent No.: US 7,260,893 B2
(45) Date of Patent: Aug. 28, 2007

(54) METHOD OF ATTACHING A TRANSMISSION OIL COOLER TO AN ALUMINUM TANK

(75) Inventors: Chris A. Calhoun, Niagara Falls, NY (US); Terry Joseph Hunt, Williamsville, NY (US); David A. Southwick, Lockport, NY (US); Karl Paul Kroetsch, Williamsville, NY (US); Krzysztof Wawrocki, Ostrow Wlkp (PL); Khalid El Moutamid, Vivier au Court (FR); Yusuke Matsunaga, Amherst, NY (US); Laurent Art, Ethe (BE)

(73) Assignee: Delphi Technologies, Inc., Troy, MI (US)

( * ) Notice: Subject to any disclaimer, the term of this patent is extended or adjusted under 35 U.S.C. 154(b) by 413 days.

(21) Appl. No.: 10/754,860

(22) Filed: Jan. 9, 2004

(65) Prior Publication Data

US 2005/0150647 A1 Jul. 14, 2005

(51) Int. Cl.

| | |
|---|---|
| ***B23P 15/26*** | (2006.01) |
| ***B21D 53/02*** | (2006.01) |
| ***F28F 9/04*** | (2006.01) |

(52) U.S. Cl. ..... 29/890.052; 29/890.03; 29/890.043; 29/890.054; 165/178; 228/183; 403/375

(58) Field of Classification Search ..... 29/890.03, 29/890.043, 890.052, 890.054; 165/178; 403/332, 375; 228/183
See application file for complete search history.

(56) References Cited

U.S. PATENT DOCUMENTS

| | | | | | |
|---|---|---|---|---|---|
| 5,464,145 | A | * | 11/1995 | Park et al. | 228/183 |
| 5,570,737 | A | * | 11/1996 | Tokutake | 165/67 |
| 5,711,370 | A | * | 1/1998 | Tanaka | 165/178 |
| 6,276,447 | B1 | | 8/2001 | Iguchi et al. | 165/178 |
| 6,293,011 | B1 | * | 9/2001 | Hasegawa et al. | 29/890.052 |
| 6,494,498 | B2 | * | 12/2002 | Brandt et al. | 285/319 |
| 6,918,434 | B2 | * | 7/2005 | Strahle | 165/167 |

FOREIGN PATENT DOCUMENTS

| | | | | |
|---|---|---|---|---|
| EP | 0846931 | A | | 6/1998 |
| JP | 11142089 | A | | 5/1999 |
| JP | 11315721 | A | | 11/1999 |
| JP | 2001074389 | A | | 3/2001 |
| JP | 2001272198 | | * | 5/2001 |
| JP | 2001221048 | A | | 8/2001 |
| JP | 2001272195 | A | | 10/2001 |
| JP | 2003130583 | A | | 5/2003 |

OTHER PUBLICATIONS

EP 04 07 8555 Search Report Dated Nov. 25, 2005.

* cited by examiner

*Primary Examiner*—David P. Bryant
*Assistant Examiner*—Sarang Afzali
(74) *Attorney, Agent, or Firm*—Patrick M. Griffin

(57) ABSTRACT

A secondary heat exchanger subassembly, such as a transmission oil cooler, is disposed in a metal tank of a radiator and has a pair of metal fluid fittings. Either a connector ring engages a fitting extending through the opening in the tank or a connector nut extends into the opening to threadedly engage the fitting whereby the metal fittings are held to the metal tank and inserted into a furnace for being brazed into sealed relationship with the metal tank.

8 Claims, 4 Drawing Sheets

METHOD OF ATTACHING A TRANSMISSION OIL COOLER TO AN ALUMINUM TANK

BACKGROUND OF THE INVENTION

1. Field of the Invention

A heat exchanger assembly of the type including an auxiliary or secondary heat exchanger sub-assembly in one of the tanks and a method of fabricating such an assembly.

2. Description of the Related Art

The present heat exchangers, particularly automotive radiators, often consist of a composite structure including tanks of a reinforced plastic attached to an aluminum core by crimping with gasket seals between the components. One or both of the tanks, typically the outlet tank, contains auxiliary or secondary heat exchanger sub-assemblies known as transmission oil coolers (TOC) or engine oil coolers (EOC). These heat exchanger sub-assemblies are usually fastened to the inside of the tank by a threaded fitting extending through an opening in the tank with a nut threaded onto the fitting to sandwich a gasket seal and the tank between the nut and the fitting.

Recently, more attention has been focused upon creating an all aluminum heat exchanger, e.g., an entire radiator including the tanks, to provide packaging advantages and recycling advantages with smaller tank width by eliminating the header crimp area between the core and the tanks. Whenever possible it is desirable to braze the components together rather than relying upon a mechanically held sealing connection between the components.

BRIEF SUMMARY OF THE INVENTION AND ADVANTAGES

The subject invention provides a method of fabricating a heat exchanger assembly to replace mechanical sealing with brazing by disposing a metal fitting of a secondary heat exchanger subassembly into engagement with the interior of a metal tank about an opening therein, mechanically holding the fitting in engagement with the tank about the opening, and brazing the metal fitting to the metal tank to seal the fitting to the tank to prevent fluid communication between the tank and the subassembly.

In accordance with the invention a heat exchanger assembly is produced comprising wherein the secondary heat exchanger subassembly has at least one fluid fitting comprising metal and the first tank comprises metal with the fitting is brazed into fluid tight sealing relationship with the first tank.

As will be appreciated, the entire heat exchanger assembly may be held together and inserted into a furnace for brazing all of the components together at one time and to replace mechanically held seals with brazing. As an option, the TOC/EOC could also have been previously brazed in a separate operation.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
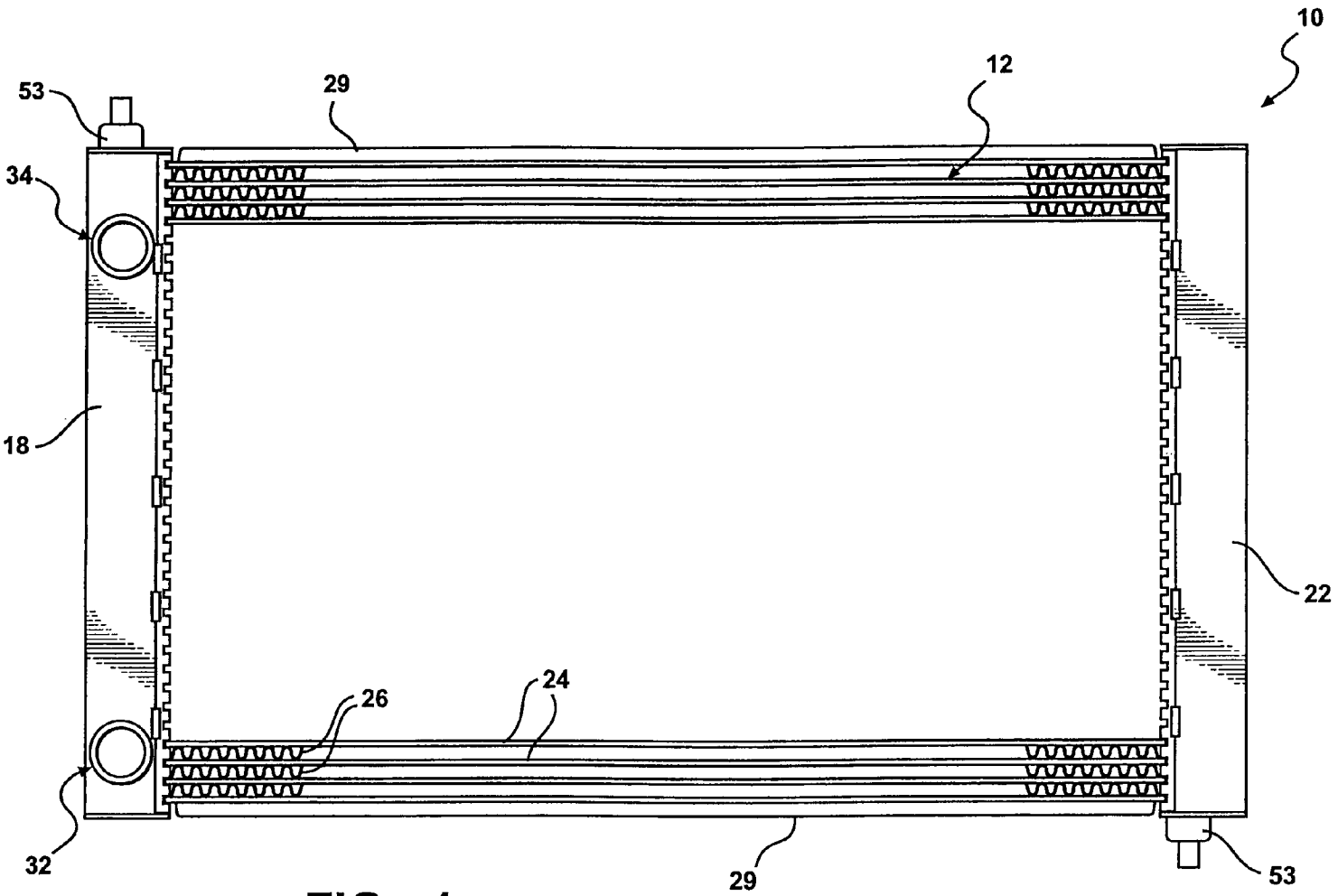
FIG. 1 is an elevational view of a heat exchanger fabricated in accordance with the subject invention.

Referring to the Figures, wherein like numerals indicate like or corresponding parts throughout the several views, a heat exchanger assembly constructed in accordance with the subject invention is generally shown at 10 in FIG. 1.

The heat exchanger assembly 10 includes a heat exchanger core 12 extending between a first tank 18 and a second tank 22 for exchanging heat with a fluid flowing between the tanks 18 and 22. The first tank 18 has a subassembly opening 20. The core 12 includes tubes 24 with heat exchanger fins 26 extending between the tubes 24, as is well known in the art. The ends of the tubes 24 are inserted into openings or slots 28 in the respective tanks 18 and 22 for fluid flow between the tanks 18 and 22. In addition, as is customary in the art, reinforcing members 29 extend along the sides of the core 12. A secondary heat exchanger subassembly 30, such as a transmission oil cooler, is disposed in the first tank 18 and has a pair of fluid fittings 32 and 34 for fluid communication with the subassembly opening 20 in the first tank 18. Preferably, all of the components are made of a metal, e.g., aluminum, and at least the first tank 18 and the fittings 32 and 34 comprise metal. Many of the components are assembled and coated with a braze clad at various interfaces for brazing the components in a sealing relationship with one another and particularly brazing the fittings 32 and 34 into fluid tight sealing relationship with the first tank 18. The fittings 32 and 34 are held in the openings 20 by a connector mechanically connected to the fitting 32 and 34 to hold the fittings 32 and 34 in engagement with the interior of the first tank 18 about the openings 20. The invention is illustrated by two different embodiments of the fitting and connector.

In the first embodiment 32 of the fitting, the fitting 32 extends through the opening 20 in the first tank 18 and includes a shoulder 44 that engages the interior surface of the tank about the opening, and the connector 35 surrounds and mechanically connects to the fitting 32 on the exterior of the metal tank 18. The fitting 32 includes an annular groove 36 and the connector 35 is disposed in the annular groove 36. More specifically, the connector 35 comprises a pair of complimentary retention rings 38 disposed in the groove 36 and having ends abutting one another with mechanical connections 40, 42 connecting the abutting ends thereof. The connections 40, 42 comprise hooks 40 on one of the rings 38 that are crimped around radial tabs on the other of the rings 38. The rings 38 may be identical with one of hooks 40 on one abutting end and one of the tabs 42 on the opposite abutting end. The braze clad is disposed on the interior surface of the connector 35 to engage the annular groove 36. Once in the brazing oven, molten braze clad flows into the interface between shoulder 44 of the fitting 32 and the interior of the tank 18. However, the braze clad could be disposed on any or all of the surfaces for melting and flowing into the interfaces to braze the components into sealing relationship with one another.

In the second embodiment 34 of the fitting, the fitting 34 does not extend thru the opening 20, it is flush with the inside of the tank surface—this provides for the maximum size TOC/EOC to fit into a given size tank. The first tank 18 and the connector 46 is mechanically connected to the fitting 34 on the interior of the first tank 18. More specifically, threads 48 are included for mechanically connecting the connector 46 to the fitting 34.

Figure 5:
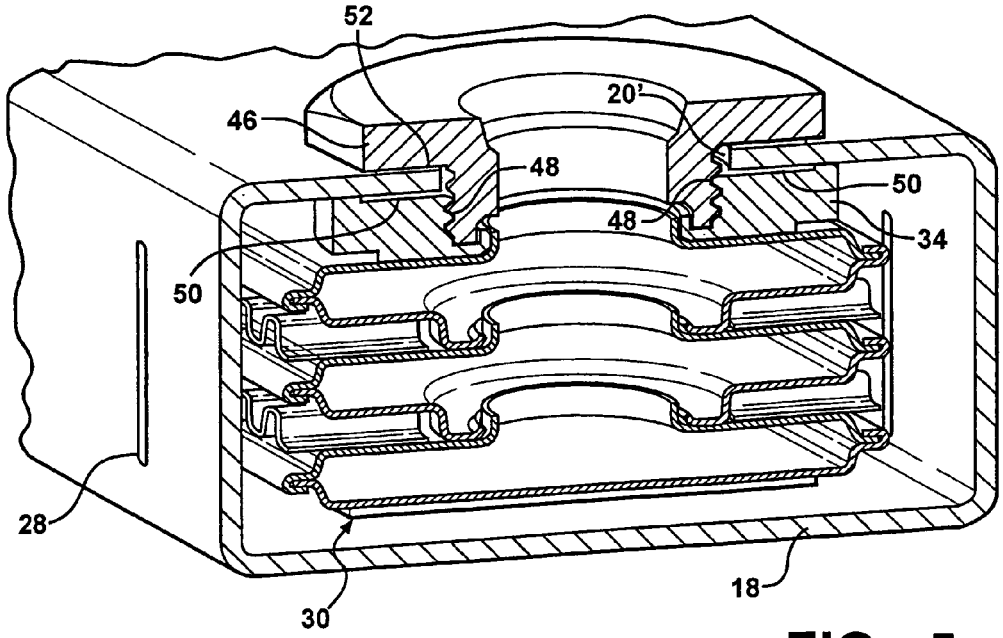
FIG. 5 is a cross sectional view of the upper fitting shown in FIG. 1.
Figure 3:
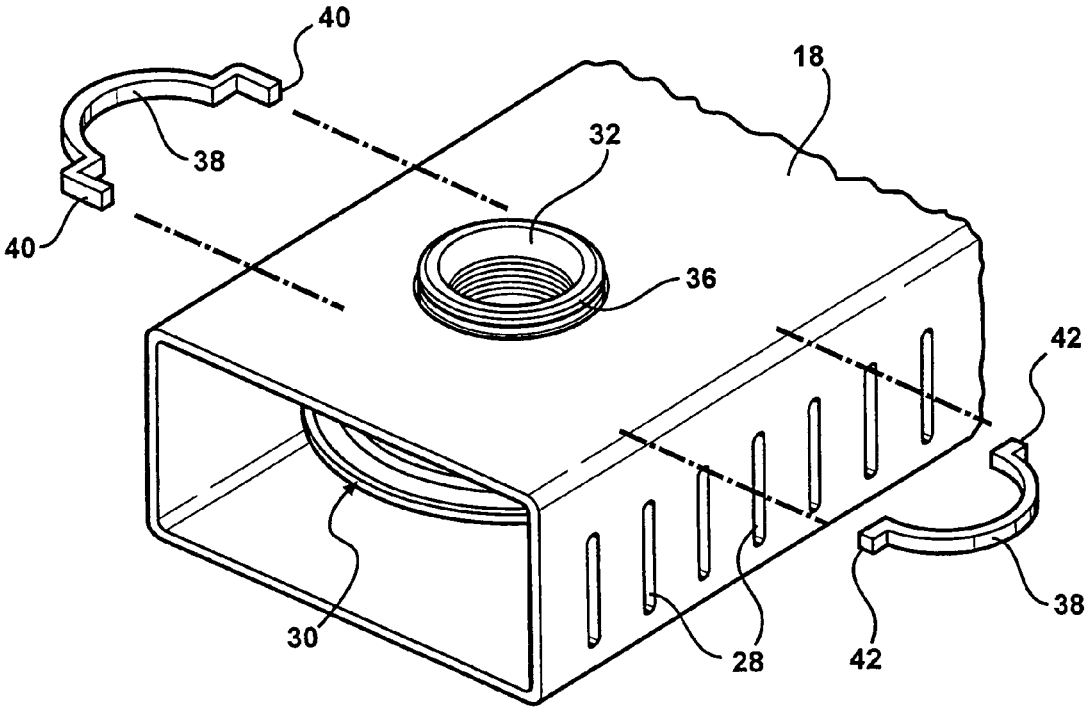
FIG. 3 is an exploded view of the lower fitting shown in FIG. 2.
Figure 4:
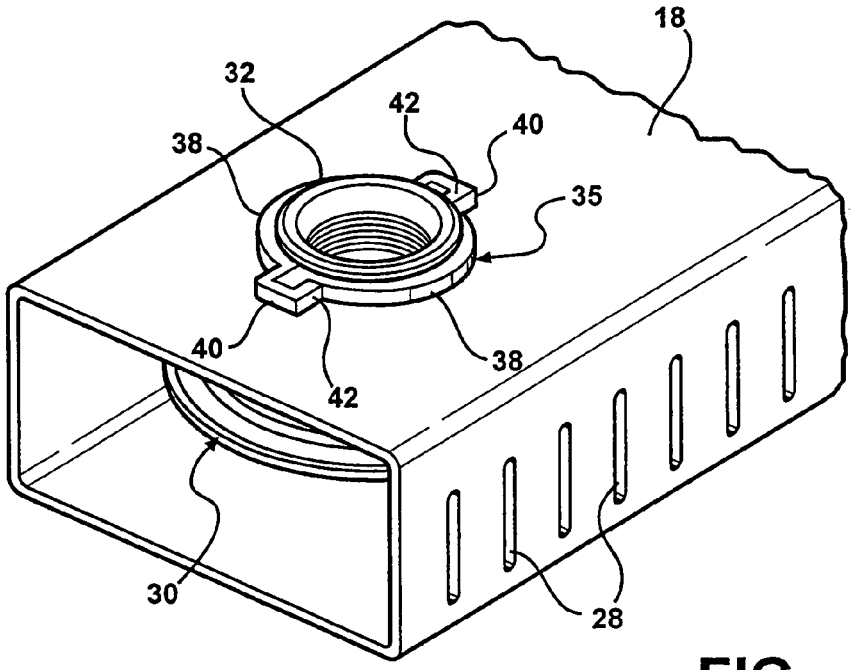
FIG. 4 is a view similar to FIG. 3 but showing the connector crimped together.
Figure 6:
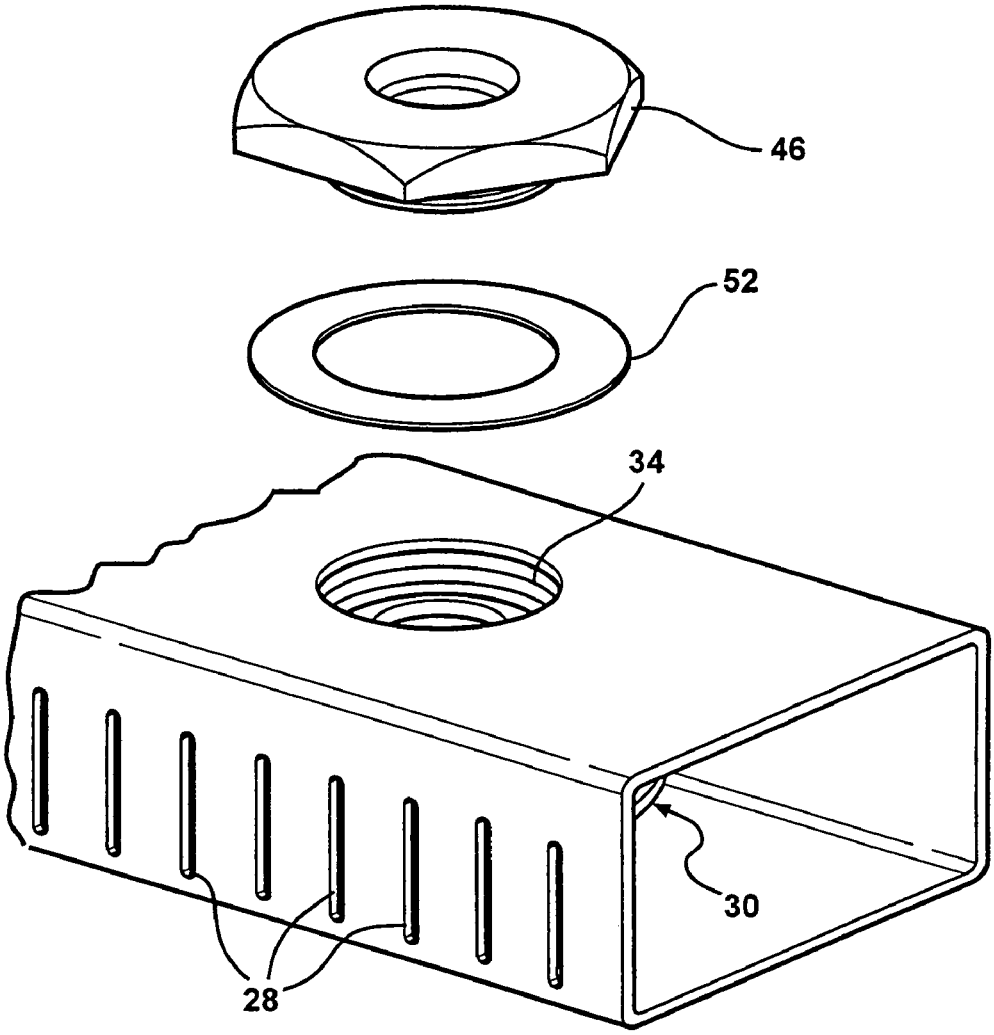
FIG. 6 is an exploded view of the elements shown in FIG. 5.

Although only illustrated in the second embodiment of FIG. 5, both embodiments of the fitting 32, 34 may include an undercut defining a gap 50 between the interior of the first tank 18 and the fitting 32, 34 about the opening 20 in the first tank 18 whereby the braze clad is disposed in the gap 50 during the brazing in an oven. A braze foil washer 52 is optional and when used is disposed between the exterior of the tank 18 about the opening 20 and the connector 46 and flows into the gap 50 during the brazing step.

Figure 2:
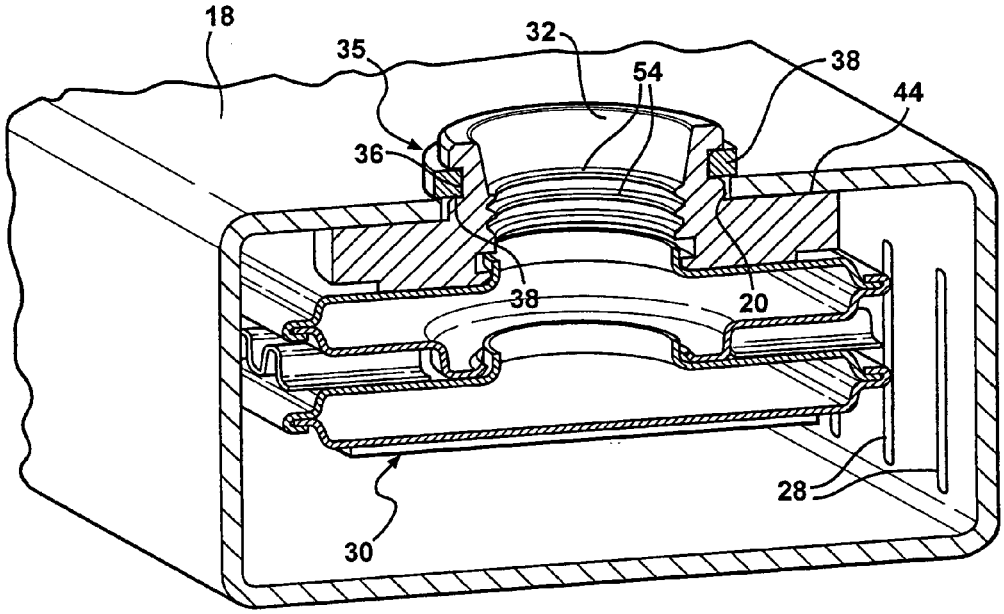
FIG. 2 is a cross sectional view of the lower fitting shown in FIG. 1.

The interior of either connector 32 or 46 may include threads 54 as shown in FIG. 2 for connection to plumbing to the transmission or engine.

Accordingly, the invention provides a method of fabricating a heat exchanger assembly 10 comprising the steps of disposing a metal fitting 32, 34 of a secondary heat exchanger subassembly 30 into engagement with the interior of a metal tank 18 about an opening 20 therein and mechanically holding the fitting 32, 34 in engagement with the tank 18 about the opening 20. While so held in position and with all of the components assembled, the method continues by simultaneously brazing the entire assembly 10 whereby the metal fitting 32, 34 is brazed to the metal tank 18 to seal the fitting 32, 34 to the tank to prevent fluid communication between the tank 18 and the subassembly 30. That is, the heat exchanger core 12 is moved into engagement with the metal tank 18 and into engagement with a second tank 22 before the entire assembly 10 is brazed together.

The mechanical holding includes mechanically connecting a connector 38, 46 to the fitting 32, 34 to sandwich the metal tank 18 between the fitting 32, 34 and the connector 38, 46. However, a braze clad is disposed on the tank about one of the fitting 32, 34. More specifically, braze clad may be disposed between the fitting and the metal tank 18, as on the radially facing interior of the retention rings 38. An undercut is provided in the fitting 32, 34 to define a gap 50 between the interior of the metal tank 18 and the fitting 32, 34 about the opening 20 in the metal tank 18. The braze clad may be conveniently brazed into the gap 50 from a braze washer 52.

The method may be further defined as extending the fitting 32 through the opening 20 in the metal tank 18 and surrounding the fitting 32 on the exterior of the metal tank 18 with the connector 35. In this case, the braze clad is disposed radially on the flat surface of the connector 35 between the fitting 32 and the connector 35. The fitting 32 is provided with an annular groove 36 and the method includes inserting the connector 35 radially into the groove 36. More specifically, the insertion of the connector 35 comprises inserting complimentary retention rings 38 into the groove 36 with the ends of the rings 38 circumferentially abutting one another followed by mechanically connecting 40, 42 the abutting ends of the retention rings 38. As explained above, the hooks at the abutting ends are crimped over the tabs 42 at the other abutting ends to mechanically connect the retention rings 38 together.

Alternatively, the method includes extending the connector 46 through the opening 20 in the metal tank 18 and mechanically connecting the connector 46 to the fitting 34 on the interior of the metal tank 18. This step may be further defined as mechanically connecting the connector 46 to the fitting 34 by threads 48.

As alluded to above, the method may include the step of providing an undercut in either fitting 32, 34 to define a gap 50 between the interior of the metal tank 18 and the fitting 32, 34 about the opening 20 in the metal tank 18 in order to facilitate brazing the braze clad of the washer 52 into the gap 50. The washer braze clad may be conveniently disposed between or under the connector 46 and the exterior of the metal tank 18 about the opening 20 therein.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A method of fabricating a heat exchanger assembly comprising the steps of:

providing a metal tank having an interior surface, an exterior surface and an opening, providing a secondary heat exchanger subassembly comprising a metal fitting having a shoulder and an annular groove, disposing the secondary heat exchanger subassembly within the metal tank such that the shoulder engages the interior surface about the opening and the metal fitting extends through the opening in the metal tank, providing a connector comprising complimentary retention rings having ends, connecting the connector to the metal fitting by radially inserting the retention rings into the groove such that the ends of the rings circumferentially abutting one another and mechanically connecting the abutting ends of the retention rings, said connector engaging the exterior surface of the metal tank opposite the shoulder such that the metal tank is disposed between the connector and the fitting and the connector mechanically holds the shoulder of the metal fitting against the interior surface of the metal tank, and brazing the metal fitting to the metal tank to seal the fitting to the tank to prevent fluid communication between the tank and the subassembly.

2. A method as set forth in claim 1 including disposing a braze clad on one of the fitting and connector for the brazing step.

3. A method as set forth in claim 2 further defined as disposing the braze clad on the connector.

4. A method as set forth in claim 2 further defined as disposing the braze clad between the fitting and the metal tank.

5. A method as set forth in claim 4 further defined as providing an undercut in the fitting to define a gap between the interior of the metal tank and the fitting about the opening in the metal tank and brazing the braze clad into the gap.

6. A method as set forth in claim 1 further comprising disposing a heat exchanger core into engagement with the metal tank and into engagement with a second tank, and simultaneously brazing the entire assembly.

7. A method as set forth in claim 1 further defined as disposing the braze clad between the fitting and the connector.

8. A method as set forth in claim 1 further defined as disposing the braze clad on the retention rings.

* * * * *